US007156389B2

(12) United States Patent
Kadowaki et al.

(10) Patent No.: US 7,156,389 B2
(45) Date of Patent: Jan. 2, 2007

(54) SHEET FEEDER AND IMAGE FORMING APPARATUS HAVING THE SAME

(75) Inventors: Hideaki Kadowaki, Kyoto (JP); Tadasu Taniguchi, Nara (JP); Mitsuyoshi Terada, Osaka (JP); Toshio Yamanaka, Yao (JP); Osamu Fujimoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 275 days.

(21) Appl. No.: 10/643,924

(22) Filed: Aug. 20, 2003

(65) Prior Publication Data

US 2005/0073087 A1 Apr. 7, 2005

(30) Foreign Application Priority Data

Aug. 20, 2002 (JP) ..... 2002-239680
Aug. 20, 2002 (JP) ..... 2002-239685

(51) Int. Cl.
*B65H 5/26* (2006.01)
*B65H 3/06* (2006.01)

(52) U.S. Cl. ..... 271/118; 271/117; 271/9.08; 271/9.09

(58) Field of Classification Search ..... 271/113, 271/117, 118, 162, 163, 9.08, 9.09, 127, 115, 271/116, 10.13
See application file for complete search history.

(56) References Cited

U.S. PATENT DOCUMENTS 5,120,042 A * 6/1992 Goto et al. ..... 271/117
6,817,793 B1 * 11/2004 Kelsay et al. ..... 400/578

FOREIGN PATENT DOCUMENTS

JP 61257844 A * 11/1986
JP 62051521 A * 3/1987
JP 05132173 A * 5/1993
JP 05162870 A * 6/1993
JP 11-171360 A 6/1999

* cited by examiner

*Primary Examiner*—Patrick Mackey
*Assistant Examiner*—Kaitlin Joerger
(74) *Attorney, Agent, or Firm*—Birch, Stewart, Kolasch & Birch, LLP

(57) ABSTRACT

A protecting cover and a pickup device, each having a hooking portion, are rotatably provided at the flank of an image forming apparatus. The rotational centers of the protecting cover and the pickup device and the hooking portions are arranged in such geometry that the hooking portions become engaged with each other only in the range from a predetermined trace intersection to the flank of the image forming apparatus when the protecting cover is rotated from its usage position toward its retracted position at the flank of the image forming apparatus. The pickup device is stopped at the starting position of engagement where the hooking portions are positioned at the trace intersection when sheet feed is not made, and is moved to the operating position when sheet feed is to be made. The protecting cover is constructed so as to rotate in linkage with the rotation of a paper feed tray which is rotatably provided at the flank of the image forming apparatus.

5 Claims, 8 Drawing Sheets

SHEET FEEDER AND IMAGE FORMING APPARATUS HAVING THE SAME

BACKGROUND OF THE INVENTION

This nonprovisional application claims priority under 35 U.S.C. § 119(a) on Patent Application No(s) 2002-239680 and 2002-239685 filed in JAPAN on Aug. 20, 2002, which is(are) herein incorporated by reference.

(1) Field of the Invention

The present invention relates to a sheet feeder for use in an image forming apparatus such as a printer, facsimile machine, copier etc., to feed sheets to the image forming apparatus, and also relates to an image forming apparatus having the same.

(2) Description of the Related Art

In a typical image forming apparatus such as a copier, printer etc., recording sheets (paper) are delivered from paper feed trays arranged in the lower part of the machine and fed to the image forming portion by way of the conveyance path. Here, the paper feed trays are receptacles which hold paper to be used for image forming. These paper feed trays hold sheets of regular sizes which are easy to form images thereon, perform beneficial conveyance and are used often.

In image forming apparatuses, however, in some cases, thin sheets, thick sheets such as post cards, sheets of various colors (colored sheets), sheets of uncommon sizes, sheets of special materials and so on may be used as recording sheets, in addition to the paper held in the paper feed trays. Such recording sheets which are rarely used (to be referred to hereinbelow as uncommon sheets) may be difficult to handle using the aforementioned paper feed trays, and it is not efficient that such uncommon sheets monopolize the limited number of paper feed trays at all times. However, it is also troublesome if recording sheets held in the paper feed tray should be replaced every time one type of uncommon sheets are used. For this reason, many of image forming apparatuses have a paper feed port on the outside (flank) of the machine, i.e., so-called manual paper feeder (an example of the sheet feeder) so as to facilitate uncommon sheets to be fed to the image forming apparatus. This manual paper feeder has a pickup device (an example of the feeding device) which places and presses a designated pickup roller onto the topmost surface of recording sheets stacked on the manual feed tray as a recording sheet receiver and turns it so as to pick up recording sheets, one by one, and feeds them into the image forming apparatus.

With recent utility enlargement of image forming apparatuses, more types of recording sheets have become used in the image forming apparatuses. Further, with the trend toward high-speed image forming, the number of sheets being able to be set at a time reaches some hundreds, and the capacity of the manual feed tray tends to be greater.

When the capacity of the manual paper feeder is made large, the conditions for picking up recording sheets vary significantly between the state where the feeder is set full of sheets and the state where the feeder is set with the minimum amount of paper or with only one sheet. Specifically, when the weight of the pickup device that is pivoted on the flank of the image forming apparatus or some repulsive force such as a spring or other elastic element is used to press the pickup roller against the recording sheets, the pickup strength varies depending on the position (height) of the pickup roller. Illustratively, the position or height of the pickup roller changes greatly between the state where many recording sheets are set and the state where a few of recording sheets are set, and this results in a large change in pickup strength. In general, when a lower amount of recording sheets are stacked (when the pickup roller is set low), the pickup strength lowers resulting in failure to pick up recording sheets.

Conventionally, in order to avoid this problem without limiting the number of recording sheets being set to a lower number, the drive force of a predetermined drive source is transmitted to the pickup device so as to urge the pickup roller against the recording sheets with a fixed force. Thereby the pickup strength of the pickup roller is made stable regardless of the number of recording sheets, thus making it possible to prevent pickup failures.

Since the manual feed tray and the pickup device which constitute this manual paper feeder are arranged so that they project from the flank of the apparatus body, the full width of the whole apparatus becomes large, causing a problem of excessive bulk. To deal with this problem, Japanese Patent Application Laid-open Hei 11 No. 171360 discloses an image forming apparatus configuration in which when the manual paper feeder is not used or when the image forming apparatus needs to be moved the manual feed tray is set upright along the flank of the image forming apparatus so as not to cause hindrance and with this movement, the pickup device is retracted into the image forming apparatus body so as not to interfere with the manual feed tray.

Here, since the pickup roller in the manual paper feeder is arranged projecting from the flank of the image forming apparatus, it is liable to be stained with sweat and grease or be damaged when accidentally touched by an operator's hands or by some other event. When the pickup roller is stained or damaged, the pickup performance may lower. In order to solve this problem, when the pickup device is arranged outside the machine body, it is necessary to prevent the pickup roller from being stained or damaged by providing a protecting cover for shielding the device.

However, this configuration with the pickup device and protecting cover provided outside the apparatus body entails the problem that when the pickup device is attempted to be retracted into the flank of the image forming apparatus body, the pickup device cannot be snugly retracted because the protecting cover stands in the way.

Further, in the case where the pickup strength is stabilized with the help of the drive force from a drive source as stated above, since the pickup device needs to be rotated opposing the static force of the drive source when the pickup device is retracted into the flank of the image forming apparatus, this configuration poses the problem that a very strong force is needed.

SUMMARY OF THE INVENTION

With consideration to the above situations, it is therefore an feature of the present invention to provide a sheet feeder and an image forming apparatus having it, which assures pickup of recording sheets by employment of a drive source and which can be retracted into the image forming apparatus by turning the pickup device (feeding device) without being affected by the static force of the drive source. Another feature of the present invention is to provide a sheet feeder and an image forming apparatus having it, of which the pickup device, even though having a protecting cover, can be snugly retracted into the flank of the image forming apparatus.

In order to achieve the above feature, the present invention provides a sheet feeder comprising: a sheet receptacle disposed at the flank of a main apparatus for holding sheets thereon; a feeding device rotatably arranged at the flank for sending sheets from the sheet receptacle into the main apparatus; and an urging mechanism for pressing the feeding means by transmission of the drive force from a predetermined drive source, characterized in that the feeding device is rotatably shifted between an operating position in which sheet feeding action is made and a retracted position in which the device is retracted at the flank of the main apparatus while a predetermined waiting position is disposed between the operating position and the retracted position, and the feeding device is urged by the urging mechanism, at least when set at the operating position and the waiting position and is freed from the urging of the urging mechanism when placed between the waiting position and the retracted position.

Since this configuration allows a feeding device, even when it is a type in which the feeding device is urged by the drive force from a driving source such as a drive motor etc., to be rotated from the waiting position to the retracted position without being affected by the static force (such as static friction) of the drive source, the feeding device can be retracted into the flank of an image forming apparatus or image scanner to which the sheet feeder is mounted, by a relatively small force.

To allow free of urging of the urging mechanism, the urging mechanism may have a predetermined range of play so that the rotation of the feeding device from the waiting position to the retracted position can be made within the predetermined range of play.

With this configuration, no static force from the drive source acts within the range of play.

To create the aforementioned play, the urging mechanism may include a projected portion (projection) joined to one of either drive source or the feeding device and a hollowed portion (hollow) joined to the other for loosely receiving the projected portion, so as to define the predetermined range of play.

With this arrangement, it is possible to provide the play with a very simple configuration.

The present invention may be considered as an image forming apparatus including the above sheet feeder.

In order to achieve the above feature, the present invention provides a sheet feeder comprising: a sheet receptacle disposed at the flank of a main apparatus for holding sheets thereon; a feeding device rotatably arranged at the flank and set at a predetermined operating position to send sheets from the sheet receptacle into the main apparatus; and a cover member covering the feeding device, characterized in that the cover member is provided on the flank side of the main apparatus, and the feeding device is rotated in linkage with the cover member when the cover member is rotated from the predetermined usage position toward the flank so that the cover member and the feeding device are retracted at the flank of the main apparatus.

With this configuration, it is possible to protect the feeding device from damage and stains by the cover member while the feeding device can be retracted compactly together with cover member into the flank of the main apparatus such as an image forming apparatus, image scanner, etc., on which the sheet feeder is provided. Therefore, it is possible to make the installation space of the apparatus small except when needed. Further, since the feeding device is retracted in linkage with the cover member, the feeding device will not be exposed when it is retracted and hence it is possible to positively prevent the feeding device from being damaged and stained.

Further, the cover member and the feeding device may have respective first and second engaging portions engaging each other, so that engagement between the first and second engaging portions will make the feeding device rotate in linkage with the cover member.

With this configuration, it is possible to provide a linkage mechanism between the cover member and the feeding device by a very simple structure.

The first and second engaging portions may be constructed so that they do not engage each other when the cover member is located in the range from the usage position to a predetermined starting position of engagement or when the feeding device is located in the range from the operating position to a predetermined starting position of engagement, and that they can engage each other when the cover member is located within the range from the starting position of engagement to the retracted position at which the cover member is retracted into the flank of the main apparatus and when the feeding device is located with the range from the starting position of engagement to the retracted position at which the feeding device is retracted into the flank of the main apparatus.

With this configuration, when the feeding device is set at the operating position, that is, when it is set at a rotated position in conformity with the number of recording sheets (the thickness of the whole recording sheets) on the sheet receptacle, the first and second engaging portions will not interfere with each other. Therefore, the movement of the feeding device will never be disturbed.

Further, the feeding device may be constructed so that it is set stationary at a predetermined waiting position between the starting position of engagement and the retracted position when it does not perform sheet feed. With this arrangement, the first and second engaging portions become engaged with each other from the starting position of engagement by rotating the cover member when the feeding device is located at the waiting position, and the feeding device is also rotated and retracted in linkage with the cover member.

Concerning a specific configuration of the first and second engaging portions, the rotational centers of the cover member and the feeding device and the first and second engaging portions may be arranged in such geometry that the trace of the first engaging portion during rotation of the cover member and the trace of the second engaging portion during rotation of the feeding device overlap only within the range from the starting position of engagement to the position at which the cover member and the feeding device are retracted.

Further, it is possible to provide a configuration in which the sheet receptacle is rotatably provided at the flank of the main apparatus, the cover member rotates in linkage with the sheet receptacle when the sheet receptacle is rotated towards the flank, and the feeding device is rotated in linkage with the cover member so that the cover member and the feeding device are retracted at the flank of the main apparatus.

With this arrangement, it is possible to retract the cover member and the feeding device by only a single movement of rotation of the sheet receptacle.

Finally, the present invention may be considered as an image forming apparatus including the above sheet feeder.

DESCRIPTION OF THE PRESENT INVENTION

The embodiment and examples of the present invention will hereinafter be described with reference to the accompanying drawings so that the present invention will be understood. The embodiment and examples hereinbelow are mere examples for embodying the present invention, and are not aimed at limiting the technical scope of the present invention.

Figure 1:
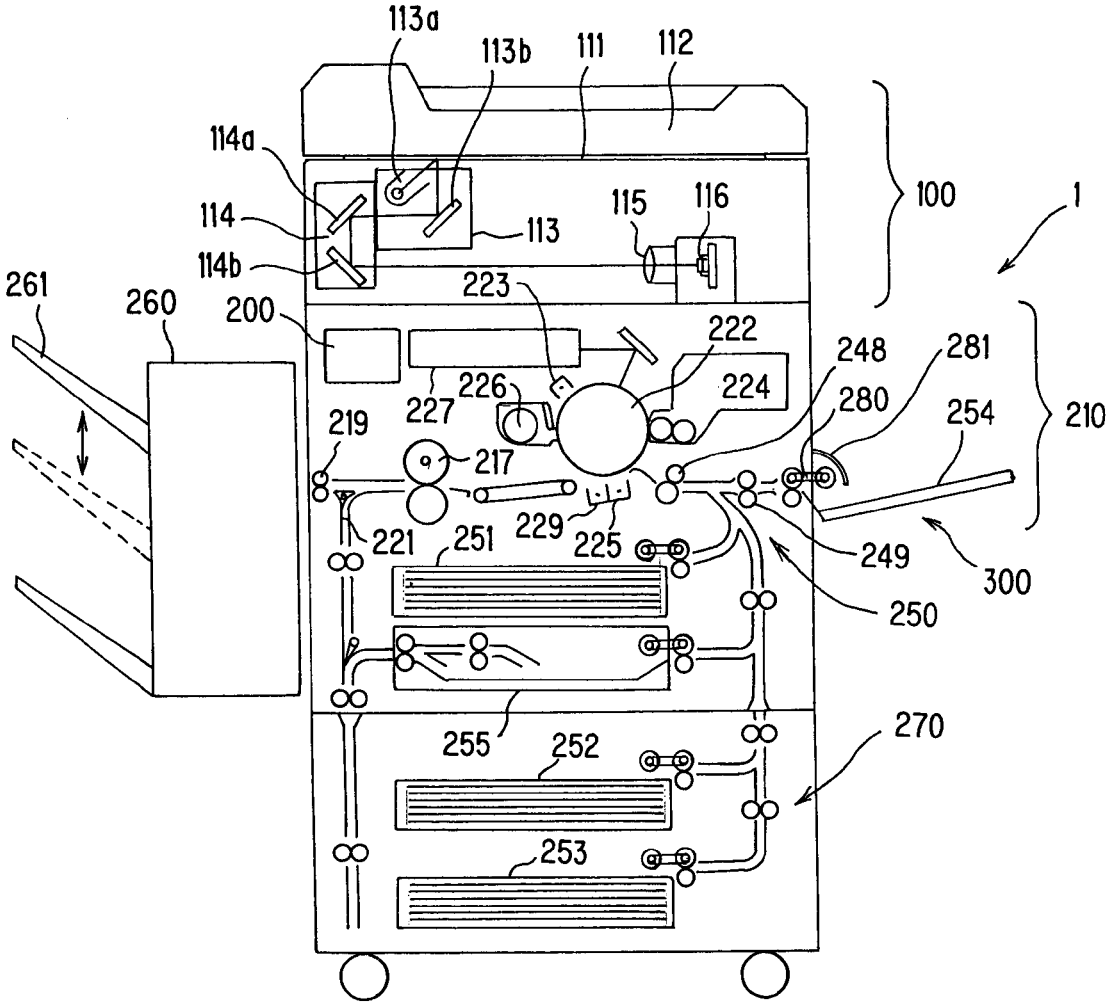
FIG. 1 shows a schematic configuration of a copier as one example of an image forming apparatus in accordance with the embodiment of the present invention.

Referring first to FIG. 1, the schematic configuration of a copier 1 as one example of the image forming apparatus according to the embodiment of the present invention will be described.

Provided on the top of this copier 1 is a document reader 100. This document reader 100 includes an automatic document feeder 112 which automatically feeds originals, one by one, to an original table 111 formed of a glass plate, from a stack of the documents set on the document set tray on top thereof.

The reading optical system of the document reader 100 for reading or scanning the image of the original, set on the original table 111 or, fed thereon by the automatic document feeder 112, is arranged under the original table 111, and includes a first scan unit 113, a second scan unit 114, an optical lens 115 for forming the image of the reflected light from the original onto a CCD line sensor 116. The first scanner unit 113 includes an exposure lamp unit 113*a* for illuminating the original image surface and a first mirror 113*b* for deflecting the reflection image of light from the original toward the predetermined direction. The second scanner unit 114 includes second and third mirrors 114*a* and 114*b* which lead the reflected light image from the original, deflected by the aforementioned first mirror, to the CCD line sensor 116.

The original image read by the document reader 100 is transferred as image data to an unillustrated image data input portion, so that the image data is subjected to predetermined image processes, then temporarily stored in the memory in an unillustrated image processor. After completion of the image processes, or in response to a predetermined output command from without, the image data is read out from the memory and transferred to a writing unit 227 that constitutes an image forming portion 210 arranged under the document reader.

The writing unit 227 includes: a semiconductor laser light source (not shown) for emitting a laser beam modulated based on the content of the image data transferred from the image processor or from an external device; a polygon mirror (not shown) for deflecting the laser beam at an equi-angular speed; and an f-theta lens (not shown) for correcting the equi-angularly deflected laser beam so that the laser spot on the photoreceptor drum 222 surface moves at a constant speed. In the present embodiment, a laser writing unit is used as the writing unit 227, but a stationary type optical writing head unit using an luminous element array such as LED or EL array may be used.

The image forming portion 210 includes the aforementioned photoreceptor drum 222 and, around the periphery thereof, further has a charger 223 for charging electricity on the photoreceptor drum 222 at a predetermined potential, a developing device 224 for supplying the static latent image formed on the photoreceptor drum 222 with toner to form a visual image; a transfer device 225 for transferring the toner image formed on the photoreceptor drum 222 surface to a recording sheet (paper); an erasing device 229 for erasing electricity on the photoreceptor drum 222; and a cleaning device 226 for collecting excess toner on the photoreceptor drum. The recording sheet with an image transferred thereon by the image forming portion 210 is then sent to a fixing unit 217 where the image is fixed to the recording sheet.

Provided on the paper output side of the image forming portion 210, in addition to the fixing unit 217, is a switchback path 221 for inverting the direction (the traveling direction) of the recording sheet for forming another image on the underside of the recording sheet and a post-processing device 260 having a lifting tray 261 for achieving various processes such as stapling over the recording sheets with formed images. The recording sheet with a toner image fixed by the fixing unit 217 passes through the switchback path 221 as necessary and is lead to the post processing device 260 by discharge rollers 219, and herein subjected to designated post processes and then discharged onto the lifting tray 261.

This copier 1 further includes: a paper tray 251 arranged under the image forming portion 210 as a paper feed portion for supplying recording sheets to the image forming portion 210; a duplex unit 255 which is connected to the switchback path 221 and temporarily holds a recording sheet when images are formed on both sides of a recording sheet; a multi-layered paper source 270 having multiple paper feed trays 252 and 253; and a manual sheet feeder 300 having a manual feed tray 254 projectively arranged on the flank of the copier 1. Further, a conveyance system 250 for conveying recording sheets set in each tray 251, 252, 253 and 254 to the transfer station of the transfer device 225 of the image forming portion 210 is provided. The duplex unit 255 is constructed so as to be replaceable with a normal paper cassette, so that a normal paper cassette may be added in place of the duplex unit 255.

Figure 2:
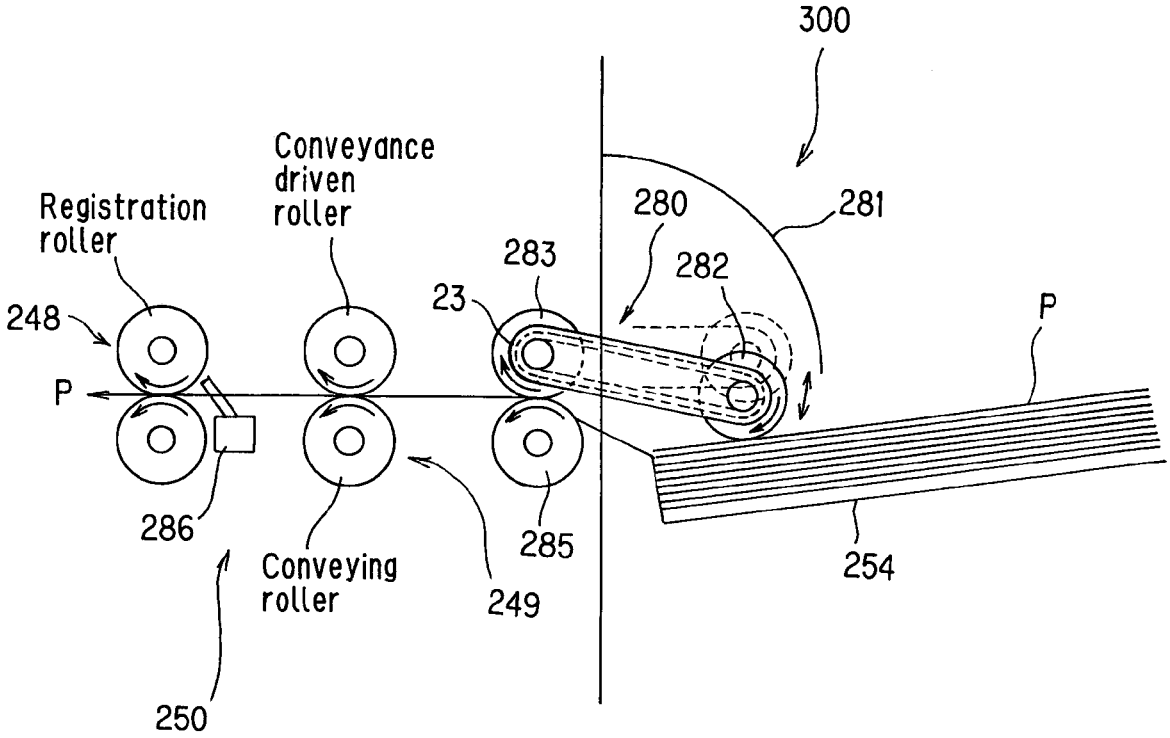
FIG. 2 is a sectional view showing the schematic configuration of a sheet feeder for an image forming apparatus in accordance with the embodiment of the present invention.

Referring next to FIG. 2, the manual sheet feeder 300 (to be referred to hereinbelow as sheet feeder 300) will be described. FIG. 2 is a sectional view showing the schematic configuration of the sheet feeder 300.

The sheet feeder 300 includes the manual feed tray 254 (one example of the sheet receptacle) which is arranged so as to project at the flank of the image forming apparatus 1 for holding recording sheets P thereon; a pickup device 280 (one example of the feeding device) for picking up recording sheets P, one by one, from the manual feed tray 254 and conveying each to the conveyance system 250 in the image forming apparatus 1; and a protecting cover 281 (one example of the cover member) for covering the pickup device 280 to protect the pickup device 280 from being stained or damaged. The manual feed tray 254, the pickup device 280 and the protecting cover 281 are rotatably supported at different axes at the flank of the image forming apparatus 1.

The pickup device 280 includes: a pickup roller 282 which is rotated as pressing recording sheets P on the manual feed tray 254; a paper feed roller 283 for delivering the recording sheet P sent from the pickup roller 282 to the conveying system 250; a drive belt 23 for transmitting the drive force from an unillustrated drive motor as a drive source to the pickup device 280. A paper separating roller 285, paired with the paper feed roller 283, separates recording sheets P, one from the others.

The recording sheet P fed from the sheet feeder 300 to a pair of conveying roller pairs 249 as a part of the conveying system 250 passes through a detector 286 for detecting passage of the recording sheet P, then is sent to a pair of registration rollers 248, where any skew of the recording sheet P is corrected and the recorded position of the image with respect to the recording sheet P is adjusted by timing control. The registration roller pair 248 is controlled as to the timing of start and stoppage of rotation by an aftermentioned controller 10. Here, the roller portions of the conveying roller pairs 249 and the paper separating roller 285 are formed of EPDM (ethylene propylene diene copolymer rubber) in this embodiment. However, CR (chloroprane rubber), urethane rubber and others can be also used.

The pickup device 280 is driven by the drive force from the drive motor (not shown) and is adapted to be driven to rotate on the axis which is an extension of the rotary shaft of paper feed roller 283. In this case, the manual feed tray 254 has a capacity of 250 sheets when recording sheets P of 80 g/m$^2$ are set. The position of the pickup roller 282 moves vertically dependent on the number of recording sheets P set on the manual feed tray 254 as the pickup device 280 rotates. In this way, the pickup roller 282 is urged against recording sheets P on the manual feed tray 254 with a constant force by the drive force from the drive motor without regarding to the number of set sheets. As a result, it is possible to feed and convey recording sheets P having a thickness or basic weight of 50 to 300 g/m$^2$, correctly from the state where the manual feed tray 254 is set full of sheets to the state where the tray is set with the minimum amount of paper.

Figure 3:
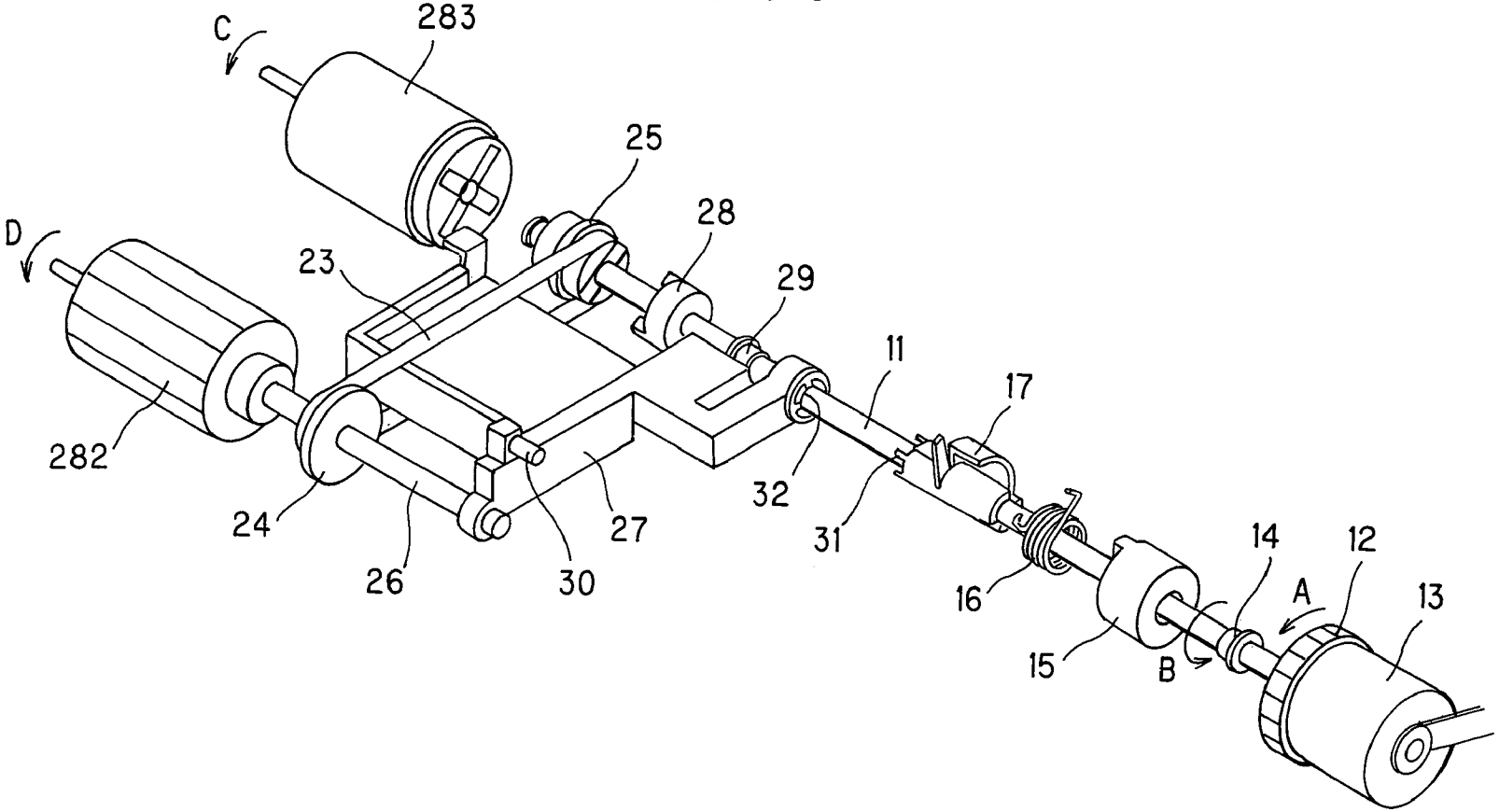
FIG. 3 is a perspective view showing an exploded state of a drive mechanism of a sheet feeder for an image forming apparatus in accordance with the embodiment of the present invention.
Figure 4:
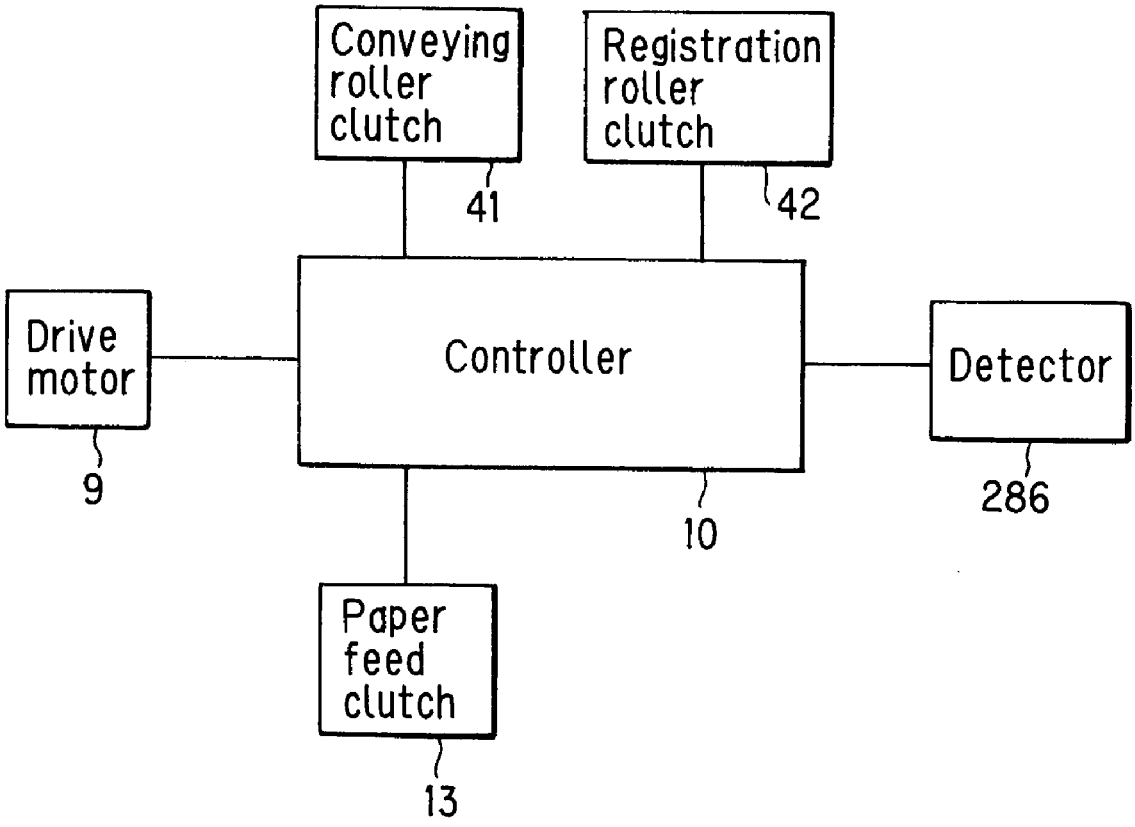
FIG. 4 is a block diagram showing the input/output scheme of the controller for an image forming apparatus in accordance with the embodiment of the present invention.

Referring next to FIG. 3, the drive mechanism of the pickup device 280 will be described. FIG. 3 is a perspective view showing parts of the drive mechanism of the sheet feeder 300.

The drive mechanism of the pickup device 280 includes: a paper feed roller shaft 11 as a rotary axis of the paper feed roller 283; a torque limiter 15 coupled to the paper feed roller shaft 11; a paper feed clutch 13 and bearing 14, a pickup link 17 rotatably supported on the paper feed roller shaft 11 and engaged with the torque limiter 15; a drive gear 12 provided for the paper feed clutch 13 and a return spring 16 engaged with the torque limiter 15.

The pickup device 280 includes: a one-way clutch 28 and bearing 29 provided on the paper feed roller shaft 11; a paper feed drive pulley 25 coupled with the one-way clutch 28 and rotatably supported on the paper feed roller shaft 11; the paper feed roller 283 coupled with the paper feed drive pulley 25; the drive belt 23 for transmitting the rotational force from the paper feed drive pulley 25; a pickup roller shaft 26 that receives rotational force from drive belt 23; a pickup drive pulley 24 and the pickup roller 282 provided on the pickup roller shaft 26; a pickup arm 27 rotatably supported on the paper feed roller shaft 11 and axially supporting the pickup roller shaft 26; and a hooking portion 30 which engages the protecting cover 281 when the pickup device 280 is retracted into the flank of the image forming apparatus 1 as will be described later.

The pickup arm 27 engages a projection 31 of the pickup link 17 that is supported on the paper feed roller shaft 11, whereby the arm is coupled allowing a predetermined amount of play with respect to the rotation of the pickup link 17. Since FIG. 3 shows an exploded view, the pickup arm 27 and the pickup link 17 are depicted apart from one another. In the actual situation, however, projection 31 (projected portion) of the pickup link 17 is loosely fitted into a hollow 32 (a hole having a width greater than that of the projection 17), so the amount of play is determined depending on the difference in size between the projection 31 and hollow 32.

The drive gear 12 is a gear which receives drive force from the drive motor as a drive source not illustrated in FIG. 3, and is adapted to rotate in the direction of A as the drive motor rotates. When the paper feed clutch 13 is activated (coupled), the rotational force of the drive gear 12 rotating in the direction of A is transmitted to the paper feed roller shaft 11 that is rotationally supported on bearing 14, so that the paper feed roller shaft 11 rotates in the direction of B (in the same direction as A). The rotational force of the paper feed roller 11 is further transmitted to the toque limiter 15.

Since the torque limiter 15 engages the pickup link 17, the rotational force of the paper feed roller shaft 11 is transmitted to the pickup link 17 by the torque limiter 15, so that the pickup link 17 also rotates in the same direction as the paper feed roller 11 (in the direction of B).

As the pickup link 17 rotates in the direction of B. projection 31 of the pickup link 17 engages the hollow 32 of the pickup arm 27 so as to urge the pickup arm 27 down, whereby the pickup roller 282 supported by the pickup arm 27 is pressed against recording sheets P set on manual feed tray 254 (not shown in FIG. 3). In this condition, a still greater driving force is transmitted, and when the contact pressure (pickup strength) between the pickup roller 282 and recording sheet P exceeds the designated level of pressure, the torque limiter 15 starts slipping with respect to the paper feed roller shaft 11, so that the rotational force exceeding the designated strength will not be transmitted and a fixed level of pickup strength can be obtained at the pickup roller 282.

On the other hand, the rotational force of the paper feed roller shaft 11 is transmitted to the paper feed drive pulley 25 via the one-way clutch 28 and is further transmitted to the paper feed roller 283 from the paper feed drive pulley 25 so that the paper feed roller 283 rotates in the direction of C. The rotational force is also transmitted from the paper feed drive pulley 25 to the pickup roller 282 by way of the drive belt 23 and the pickup drive pulley 24, whereby the pickup roller 282 rotates in the direction of D to pick up a recording sheet P.

Here, if the following recording sheet or sheets P are conveyed together by the pickup roller 282 to the paper feed roller 283, the following sheets P will not be conveyed beyond the paper separating roller 285, which is provided opposing the paper feed roller 283. That is, another torque limiter, not illustrated, is provided for the paper separating roller 285, and if two or more recording sheets P are about to be pulled and nipped between the paper feed roller 283 and the paper separating roller 285, the paper separating roller 285 is adapted to stop rotating due to the increased load. In this way, two or more recording sheets P will not be fed beyond the paper feed roller 283.

In this embodiment, a roller type is used for the separating device of recording sheets, but a pad type separating device can also provide similar effect.

After recording sheet P becomes nipped between conveying roller pair 249 (see FIG. 2) located downstream of the paper feed roller 283, the paper feed clutch 13 is turned off so that the drive force acting on the paper feed roller 283 etc., is freed (no drive force acts) and the pickup roller 282 returns to the predetermined waiting position away from recording sheets P and is set into the waiting mode. The movement of separation to this waiting position can be caused by torsional repulsive force of the return spring 16 of a torsion coil spring type, wound on the pickup link 17. In this embodiment, a torsion coil spring is used as the return spring 16, but a tensile coil spring or other element may be used.

The paper feed roller 283 is idly turned following the conveyance of the recording sheet P when the drive force to paper feed roller 283 is shut off by the one-way clutch 28.

Control of the operation of conveyance of the recording sheet P is performed by a predetermined controller 10 including a CPU and others. That is, when a detecting signal is input from the detector 286, ON/OFF controls of the paper feed clutch 13, a conveying roller clutch 41 provided for the conveying roller 249, a registration roller clutch 42 provided for the registration roller 248, and others are performed based on the detection. The controller 10 also makes ON/OFF control of the drive motor 9.

For the detector 286, a lead sensor or photosensor having a contact type actuator or a non-contact type photosensor or the like may be employed.

Figure 5:
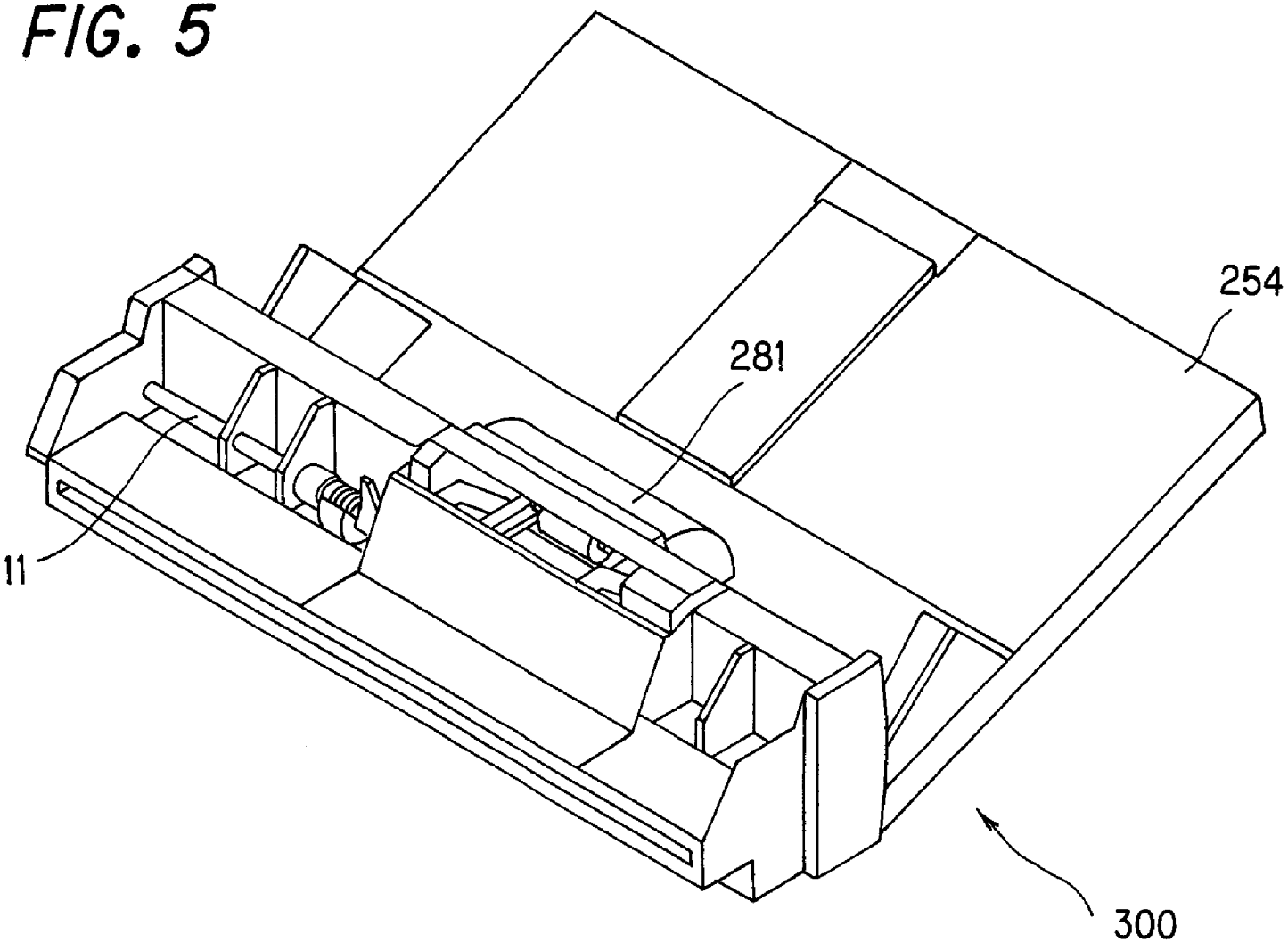
FIG. 5 is a perspective view showing the appearance of a sheet feeder for an image forming apparatus in accordance with the embodiment of the present invention.

FIG. 5 is a perspective view showing the appearance of the sheet feeder 300. As shown in FIG. 5, the manual feed tray 254 and the protecting cover 281 are exposed, outside, and other components are covered by the protecting cover 281 and other plastic receptacles etc.

Figure 6A:
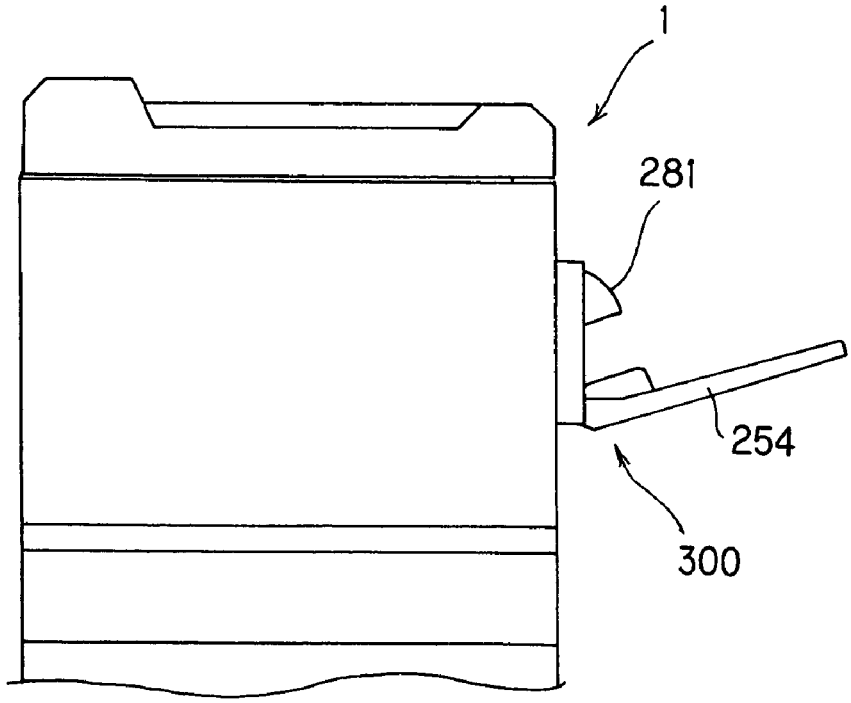
FIGS. 6A, 6B and 6C are views showing the usage state and retracted state of a sheet feeder arranged on the flank of an image forming apparatus in accordance with the embodiment of the present invention.
Figure 6B:
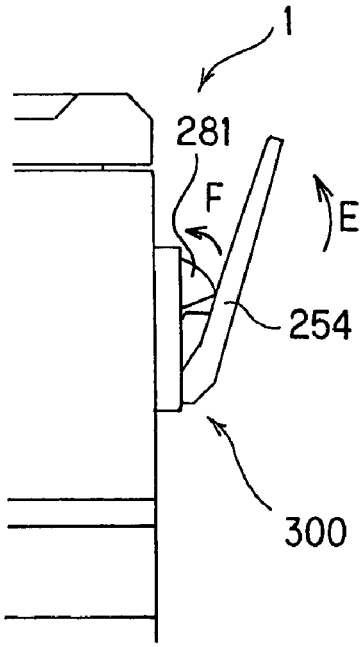
Figure 6C:
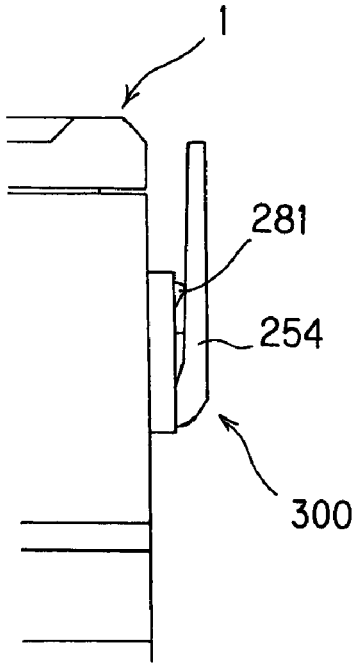

FIGS. 6A, 6B and 6C are views showing the usage state and retracted state of the sheet feeder 300.

The sheet feeder 300 is disposed at the flank of the image forming apparatus 1 as shown in FIG. 6A. FIG. 6A shows a state in which the manual feed tray 254 is used. As shown in FIG. 6C, the sheet feeder 300 is constructed so that the manual feed tray 254 can be rotated in the direction of E (in the direction in which it approaches the flank of the image forming apparatus 1) when it is not used or when the image forming apparatus 1 needs to be moved. With the rotational movement of the manual feed tray 254, the protecting cover 281 also moves in the direction of F. Further, in time with the rotation of the protecting cover 281, the pickup device 280 arranged inside the protecting cover 281 also rotates, so that the manual feed tray 254 can be set upright along the flank of the image forming apparatus 1 while the protecting cover 281 and the pickup device 280 can be retracted at the flank of the image forming apparatus 1. FIG. 6C shows a state in which the protecting cover 281 and the pickup device 280 are retracted. In this image forming apparatus 1, in order to make the whole machine compact, the sheet feeder 300 which is projected outside the machine body can be easily housed inside the machine body by rotating the manual feed tray 254.

Figure 7A:
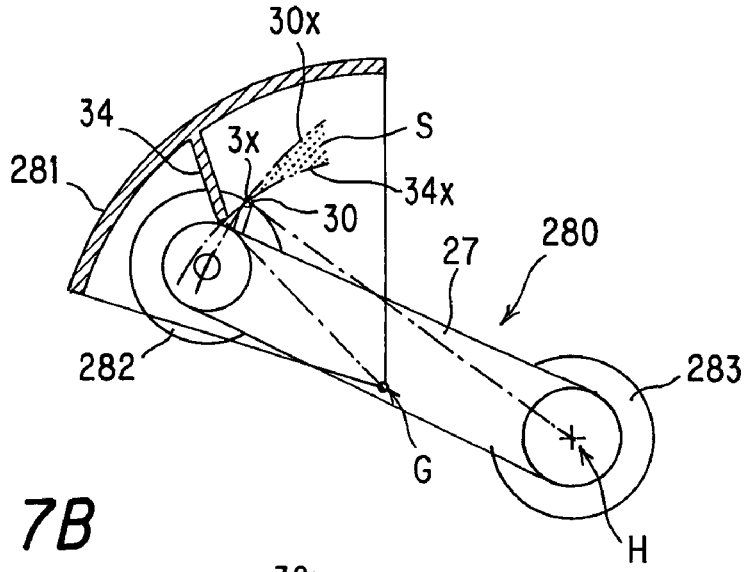
FIGS. 7A, 7B and 7C are schematic sectional views showing the way a protecting cover and pickup device of a sheet feeder rotate when they are retracted in an image forming apparatus in accordance with the embodiment of the present invention; and, FIGS. 8A, 8B and 8C are schematic sectional views showing the coupling state of a pickup device of a sheet feeder with the drive source side in the image forming apparatus in accordance with the embodiment of the present invention.
Figure 7B:
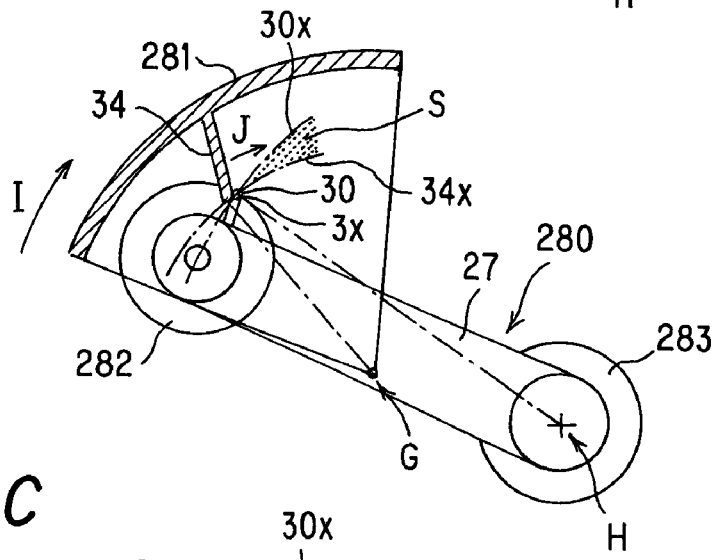
Figure 7C:
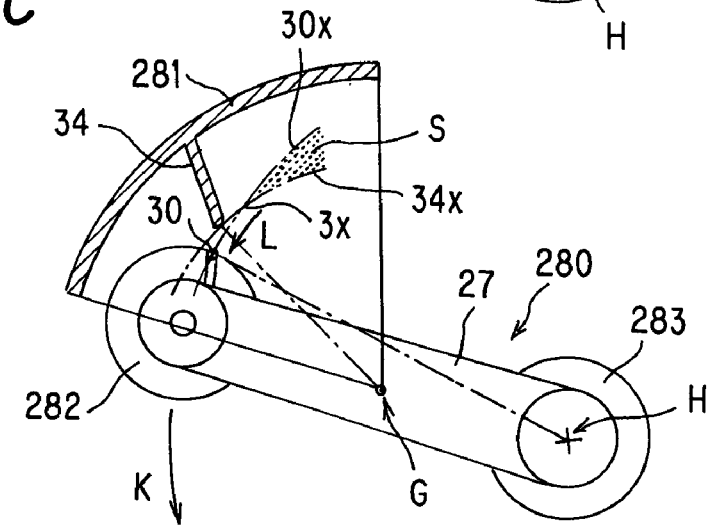

Referring next to FIGS. 7A, 7B and 7C, the mechanism for retracting the protecting cover 281 and the pickup device 280 will be described.

FIGS. 7A, 7B and 7C are schematic sectional views showing the way the protecting cover 281 and the pickup device 280 of the sheet feeder 300 rotate when they are retracted.

FIG. 7A shows a state in which the pickup device 280 is held at the predetermined waiting position when sheet feed is not made by the pickup device 280 (to be referred to hereinbelow as the waiting mode). In the waiting mode, the manual feed tray 254 is positioned at that shown in FIG. 6A and is ready for feeding of recording sheets P.

FIG. 7C shows a state in which the pickup device 280 is rotated in the direction of K, partway to the predetermined operating position in order to set the device ready for feeding of recording sheets. Here, the operating position means a position at which the pickup roller 282 is put in contact with the recording sheet so as to be able to pickup the recording sheet. FIG. 8C shows the state in which the pickup device 280 stands at the operating position. The pickup device 280 is usually held to stand at the waiting position (FIG. 7A) and is controlled by the controller 10 so as to move (rotate in the direction of K) to the operating position (FIG. 8C) when recording sheets need to be fed. A shift between the waiting position and the operating position causes the pickup device 280 only to rotate while the protecting cover 281 remains stationary. The position of the protecting cover 281 shown in FIGS. 7A and 7C is referred to hereinbelow as the usage position of the protecting cover 281.

When the protecting cover 281 is rotated in the direction of I from the state shown in FIG. 7A where the protecting cover 281 and the pickup device 280 stand at the usage position and the waiting position, respectively, a hooking part 34 (one example of the first engaging portion) provided on the inner side of the protecting cover 281 also rotates about the rotational axis G of the protecting cover 281. Here, the trace (arc) drawn by the distal end of hooking part 34 of the protecting cover 281 when the protecting cover 281 is rotated is shown by a two-dot chain line 34*x* (which includes the extension of the trace). Similarly, the trace (arc) drawn by the distal end of hooking part 30 (one example of the second engaging portion) provided for the pickup device 280 when the pickup device 280 is rotated (about the rotary axis H) is shown by a single-dot chain line 30*x*. As shown in FIG. 7C, in the image forming apparatus 1, the trace of the hooking part 34 drawn when the protecting cover 281 rotates and the trace of the hooking part 30 drawn when the pickup device 280 rotates cross each other at a trace intersection point 3*x* and overlap only in the range (part of the overlap range is depicted by a dotted area S) from the trace intersection point 3*x* to an unillustrated position (to be referred to hereinbelow as the retracted position) at which the protecting cover 281 and the pickup device 280 are retracted as shown in FIG. 6C. In other words, the rotational centers G and H of the protecting cover 281 and the pickup device 280 and their hooking parts 34 and 30 are laid out in such geometry that part of arc 34*x* of the hooking part 34 on the retracted position side from the trace intersection point 3*x* is included in the interior (the area closer to the rotational center) of arc 30*x* of the hooking part 30.

By this arrangement, the two hooking parts 34 and 30 interlock each other only in the range from the trace intersection point 3*x* toward the retracted position (the area closer to the flank of image forming apparatus 1). The positions of the protecting cover 281 and the pickup device 280 when the distal ends of the hooking parts 34 and 30 are located at the trace intersection point 3*x*, will be hereinbelow called the starting positions of engagement. FIG.7B shows a state in which both the protecting cover 281 and the pickup device 280 are positioned at the starting positions of engagement, respectively, or the hooking parts 34 and 30 start to be engaged with each other. As shown in FIG.7B, the starting position of engagement of the protecting cover 281 resides at the predetermined point between the usage position (FIG.7A) and the retracted position (not shown) and the starting position of engagement of the pickup device 280 resides at the predetermined point between the operating position (FIG.7C) and the retracted position (not shown). The present embodiment is configured such that the waiting position of the pickup device 280 coincides with the starting position of engagement.

Thus, a very simple structure makes it possible for the pickup device 280 to pick up recording sheet P without being disturbed by hooking part 34 of the protecting cover 281 when the device is set at the operating position. Since the pickup device 280 remains stationary at the waiting position (FIG.7A) when no pickup operation is made, the protecting cover 281 is rotated in the direction of I (toward the retracted position), then hooking part 34 of the protecting cover 281 engages hooking part 30 of the pickup device 280 and the pickup device 280 rotates toward the retracted position in linkage with the rotation of the protecting cover 281. Thus, when the protecting cover 281 is retracted into the flank of the image forming apparatus 1 by rotating it toward the retracted position, the pickup device 280 is also retracted into the flank of the image forming apparatus 1 in linkage with the protecting cover 281. The image forming apparatus 1 is constructed such that when the manual feed tray 254 is made to stand upright along the flank thereof by manually rotating it, the manual feed tray 254 abuts the protecting cover 281 (the state shown in FIG.6B) and the protecting cover 281 is rotated toward the retracted position by the abutment force. Thereby, as the manual feed tray 254 is rotated so as to stand upright, the protecting cover 281 and the pickup device 280 rotate together and are retracted into the flank of the image forming apparatus 1. It is of course possible to couple the manual feed tray 254 and the protecting cover 281 using a certain linkage or other mechanisms so that the protecting cover 281 will rotate in linkage with the rotation of the manual feed tray 254.

Figure 8A:
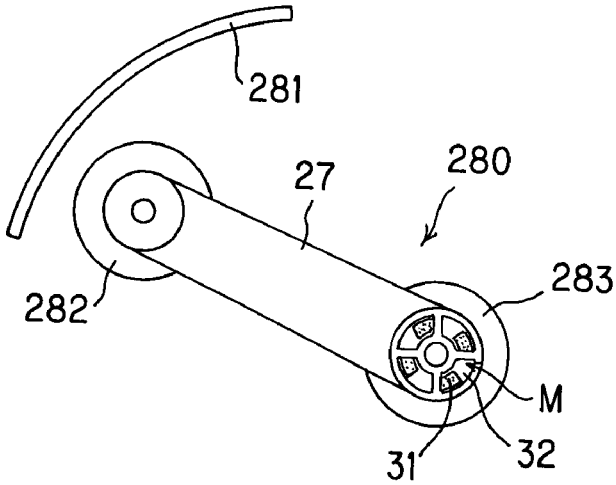
Figure 8B:
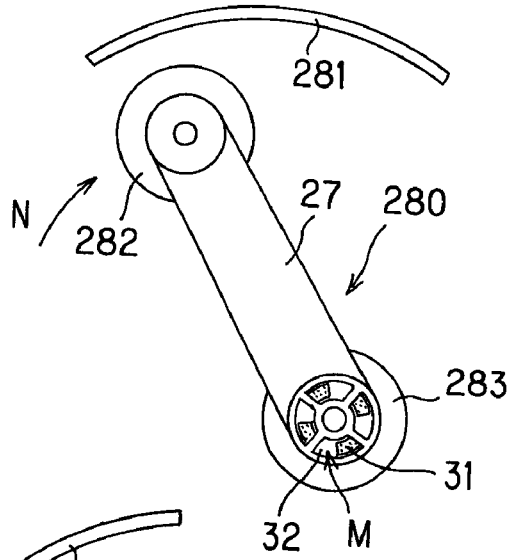
Figure 8C:
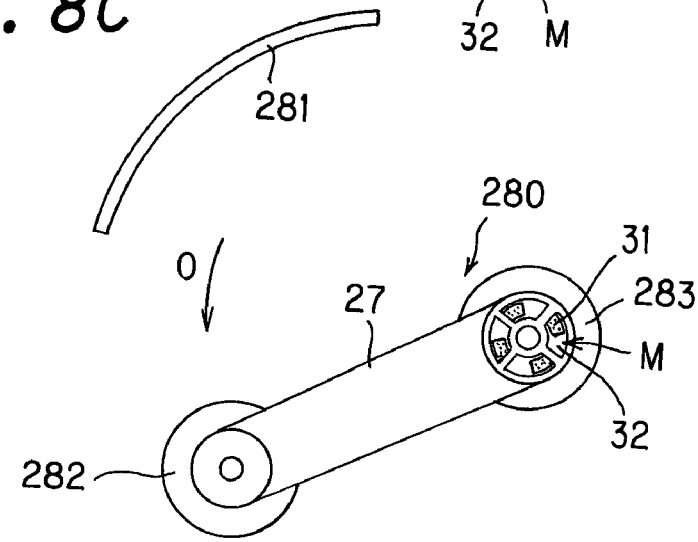

Referring next to FIGS. 8A, 8B and 8C, the action owing to provision of play in the coupling between the pickup link 17 and the pickup arm 27 (see FIG. 3) in the sheet feeder 300 will be described.

FIGS. 8A, 8B and 8C are schematic sectional views showing the coupling state between hollow 32 provided for the pickup arm 27 (not shown in FIGS. 8A, 8B and 8C) of the pickup device 280 and projection 31 formed in the pickup link 17 on the drive source side. Here, FIGS. 8A, 8B and 8C show the pickup device 280 being set at the waiting position (corresponding to the position in FIG. 7A), the retracted position and the operating position, respectively.

As stated above, the projection 31 formed on the pickup link 17 is loosely fitted in the hollow 32 formed in the pickup arm 27. The width of projection 31 with respect to the rotational direction is formed small enough compared to the hollow 32. This means that a space M having the predetermined width, which is not occupied by the projection, forms.

As shown in FIG. 8A, when the pickup device 280 is located at the waiting position, the projection 31 abuts and presses the end face of the hollow 32, located on the side, causing the device to rotate in the retracted position, so as to support the weight of the pickup device 280. As the manual feed tray 254 (not shown) is rotated from the state shown in FIG. 8A, to the retracted side, the protecting cover 281 and the pickup device 280 rotate in the direction of N (in the direction toward the retracted position) as shown in FIG. 8B, together with the rotating action of the manual feed tray 254. With the rotation of the pickup device 280 in the direction of N, hollow 32 of the pickup arm 27 rotates in the same direction. Here, since the aforementioned space M (play) exists in the hollow 32, the pickup device 280 remains free from coupling with the projection 31, hence can be turned in the direction of N by only giving the rotational force opposing the weight of the pickup device 280. At this moment, since the pickup link 17 does not move, the projection 31 remains stationary without rotation at the waiting position (FIG. 8A). So, when space M of the hollow 32 is formed so as to allow the pickup device to rotate from the waiting position (FIG. 8A) to the retracted position (FIG. 8B) within the range of the space M (play), the protecting cover 281 and the pickup device 280 can be retracted by a relatively small force, without being affected by the static force (such as static friction) of the pickup link 17 coupled with the drive motor 9 or other drive sources.

On the other hand, when recording sheets P are sent out, the projection 31 receives drive force by way of the drive gear 12, paper feed roller shaft 11 and torque limiter 15 (see FIG. 3), and rotate in the direction of O (toward the operating position) from the state shown in FIG. 8A, so that the projection 31 urges the end face of the hollow 32, located on the side, causing the device to rotate in the operating position, whereby the pickup roller 282 of the pickup device 280 urges recording sheets P with a fixed force to make a pickup action. In this case, the protecting cover 281 does not move and only the pickup device 280 rotates in the direction of O.

As has been described heretofore, according to the present invention, when the sheet feeder is not used, the feeder can be retracted at the flank of the image forming apparatus so as to make the apparatus size compact. Further, in the sheet feeder of a type in which the feeding device (the pickup device 280 etc.) thereof is driven by a drive source such as a drive motor so as to ensure reliable pickup of recording sheets, the pickup device and the protecting cover for it can be retracted with a relatively small force without being affected by the static force of the drive source.

Further, the configuration of the present invention is very simple and yet the feeding device (pickup device) is protected from damage and stains by means of a protecting cover (cover member) while the protecting cover will not disturb the sheet feeding operation of the feeding device during use of the manual sheet feeder and can be retracted together with the feeding device to the flank of the image forming apparatus when it is not used, thus making it possible to make the apparatus size compact.

What is claimed is:

1. A sheet feeder, comprising:

a sheet receptacle disposed at the flank of a main apparatus for holding sheets thereon;

a feeding device rotatably arranged at the flank for sending sheets from the sheet receptacle into the main apparatus, the feeding device being rotatably shifted between an operating position in which sheet feeding action is made and a retracted position in which the device is retracted at the flank of the main apparatus while a predetermined waiting position is disposed between the operating position and the retracted position; and an urging mechanism for pressing the feeding device by transmission of the drive force from a predetermined drive source, the urging mechanism being adapted to urge the feeding device only when the feeding device is at the operating position and the waiting position.

2. The sheet feeder according to claim 1, wherein the urging mechanism has a predetermined range of play so that the rotation of the feeding device from the waiting position to the retracted position can be made within the predetermined range of play.

3. The sheet feeder according to claim 2, wherein the urging mechanism includes a projected portion joined to one of either the drive source or the feeding device and a hollowed portion joined to the other for loosely receiving the projected portion, so as to define the predetermined range of play.

4. An image forming apparatus, comprising:

a sheet feeder according to claim 1.

5. The sheet feeder according to claim 1, wherein the urging mechanism does not urge the feeding device when the feeding device is placed between the waiting position and the retracted position.

* * * * *